United States Patent [19]

Garrelfs et al.

[11] Patent Number: 4,595,355

[45] Date of Patent: Jun. 17, 1986

[54] FORCED DRAFT BURNER

[75] Inventors: Peter A. Garrelfs, Etobicoke; Walter H. Young, Scarborough, both of Canada

[73] Assignee: Pendell Boiler Limited, Toronto, Canada

[21] Appl. No.: 696,233

[22] Filed: Jan. 29, 1985

[51] Int. Cl.[4] ..... F23Q 3/00

[52] U.S. Cl. ..... 431/265; 431/183

[58] Field of Search ..... 431/265, 183, 186, 189, 431/264, 351, 353, 350; 239/403–406

[56] References Cited

U.S. PATENT DOCUMENTS

| | | | |
|---|---|---|---|
| 2,570,996 | 10/1951 | Walshin | 431/265 |
| 3,469,790 | 9/1969 | Duncan | 431/265 |
| 4,140,476 | 2/1979 | Kaplan | 431/265 |
| 4,383,820 | 5/1983 | Camacho | 431/265 |
| 4,407,879 | 9/1977 | Mitchell et al. | 431/265 |

FOREIGN PATENT DOCUMENTS

| | | | |
|---|---|---|---|
| 1335912 | 7/1963 | France | 431/265 |

*Primary Examiner*—James C. Yeung

*Attorney, Agent, or Firm*—Arne I. Fors; Robert F. Delbridge

[57] ABSTRACT

A forced-draft burner including a cylindrical blast tube and an inner tube concentric with the blast tube defining an annular space therebetween for the flow of combustion air, the inlet end of the inner tube having a 90° bend for securement to a side wall of the burner and the outer end of the inner tube extending beyond the blast tube, said inner tube outer end being closed and having peripheral openings to form a nozzle, vanes fixed on the inner tube within the annular space for imparting a preliminary swirl to combustion air, and a spinner blade mounted on the inner tube planar with the end of the blast tube to impart additional rotary swirl to the combustion air prior to the introduction of fuel thereto, said spinner blade having a circumference less than the diameter of the blast tube to define an annular space adjacent the blast tube. The inner tube, internal vanes and spinner blade can be axially adjusted within the blast tube or removed for servicing or replacement as an integral unit.

2 Claims, 6 Drawing Figures

FORCED DRAFT BURNER

This invention relates to a forced-draft burner of the type used in oil or gas-fueled furnaces and boilers.

Forced-draft burners generally comprise a fan to provide a source of combustion air into a blast tube, a fuel nozzle, an igniter, and means to mix fuel and air (for instance, vanes to swirl inlet air around the fuel nozzle) in order to achieve efficient combustion of the fuel. The exact relationship between the various components, including the swirl vanes and the blast tube, must be adjusted or tuned to maximize efficiency for a given flow of air and fuel.

From time to time such burners must be dismantled to be cleaned or repaired, and consequently the adjustment of the air-fuel mixing components must be reset after cleaning or repairing. This usually involves resetting the swirl vanes and adjusting the relative positions of the components, both of which take time and incur expenses.

This invention helps to overcome this problem, by providing a pre-alignment of certain critical components in the burner, specifically of the swirl vanes and the fuel inlet nozzle and tube, permitting easy replacement or substitution of all components at the burner installation. Repair of a damaged assembly accordingly can be done at a workshop without undue interruption of service.

The forced-draft burner of my invention comprises, in combination a housing having a rectangular base and a pair of opposed side walls; a cylindrical blast tube extending from said housing adapted to be connected to a source of forced-draft combustion air; an inner tube substantially concentric with and spaced from said blast tube, defining an annular space therebetween, said inner tube extending from within the housing through the blast tube; said pair of substantially concentric tubes having inlet and outlet ends, the inlet end of the inner tube having a substantially 90° bend whereby the inlet end of the inner tube orbits a housing side wall, and the outlet end of the inner tube extending beyond the outlet end of the blast tube, said inner tube outlet end having a closed end with equispaced discharge outlets formed around the periphery of the inner tube extending beyond the blast tube forming a nozzle for discharging fuel radially outwardly from said inner tube; means for removably connecting said inner tube inlet end to the housing side wall, said housing side wall having an opening therein for communicating a source of fluid fuel to the inner tube; vane means positioned within the annular space, said vane means being fastened to said inner tube at a pre-selected point between the said inlet and outlet ends; a circular spinner blade mounted at the outlet end of the blast tube, said spinner blade having a diameter smaller than the diameter of the blast tube to define a narrow annular slot adjacent the blast tube and said spinner blade having a plurality of vanes about its periphery, for the discharge of and annular flow of outer air with a swirling flow of inner air; said inner tube being axially removable from the blast tube and housing without substantially changing the position of the vanes in relation to the inner tube; and means to ignite said fuel.

The spinner blade preferably is secured to the inner tube for removal with the inner tube as a unit.

The foregoing and other advantages of the invention and the manner in which they can be attained will become apparent from the following detailed description of the apparatus, in which:

FIG. 4 is a perspective view of the fuel outlet assembly, showing the vanes mounted on the inner tube;

FIG. 5 is a plan view of the spinner blade; and

FIG. 6 is a side view of the spinner blade shown in FIG. 5.

Figures 1, 2:
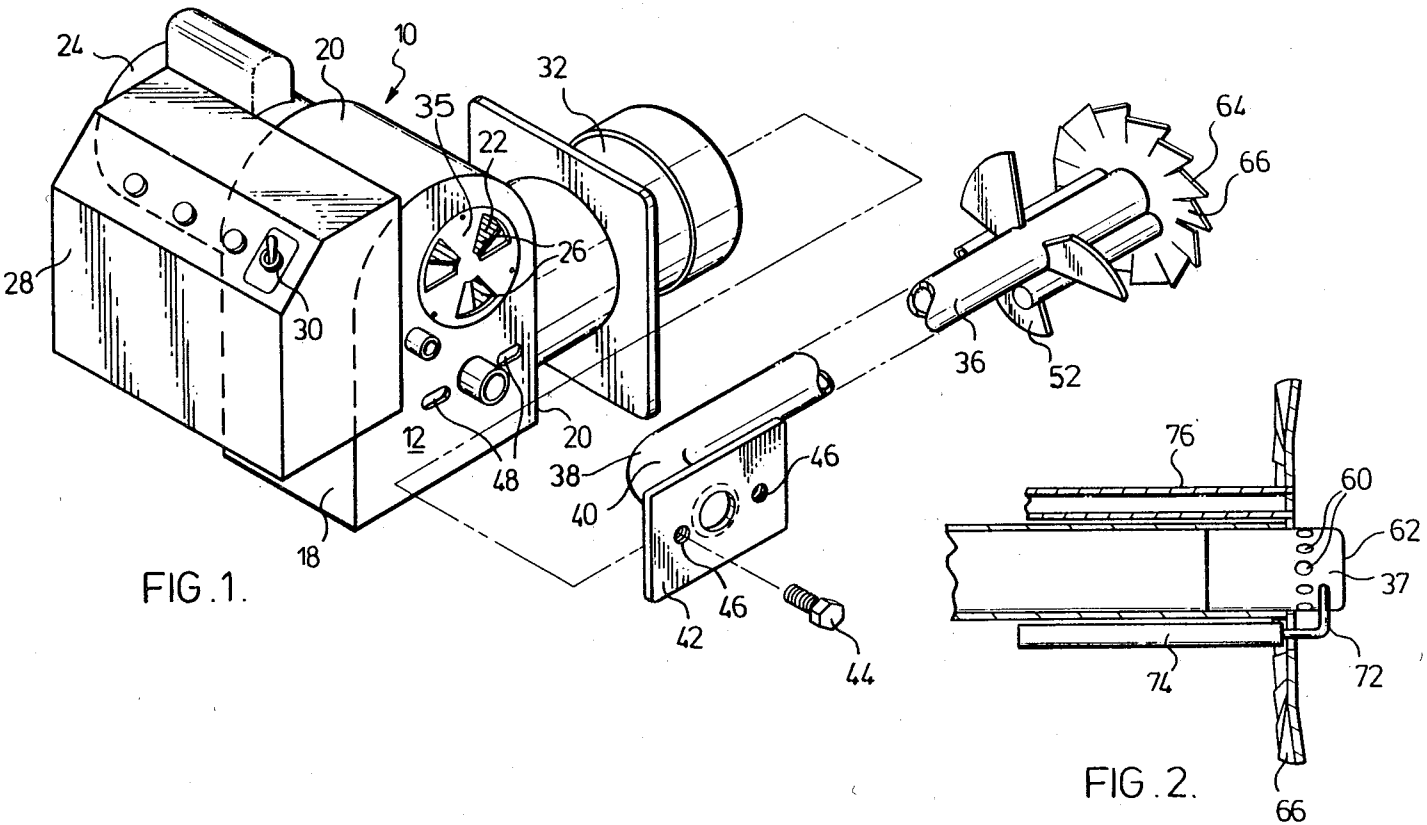
FIG. 1 is an exploded perspective view of the forced-draft burner of the invention.
FIG. 2 is a longitudinal horizontal section of the fuel outlet assembly.
Figure 3:
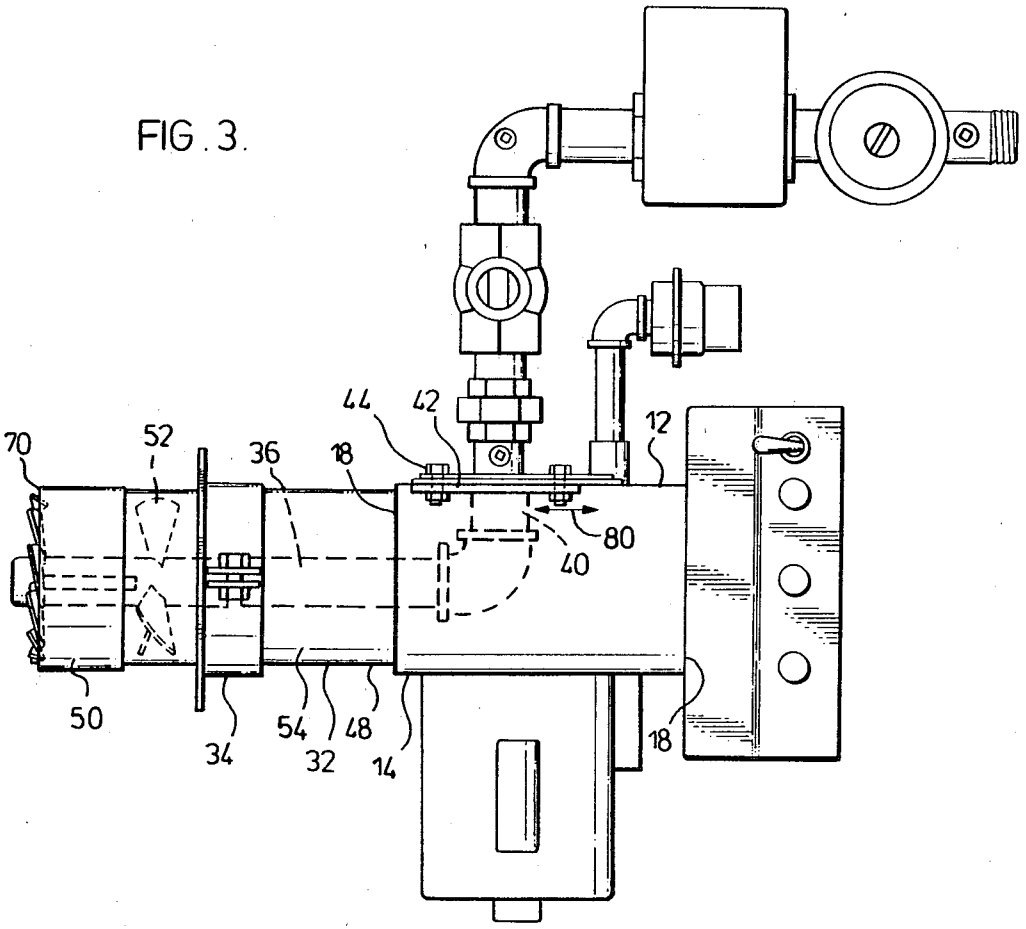
FIG. 3 is a plan view of the burner of the present invention.

With reference now to FIGS. 1, 3 and 5, blower housing 10 is a standard construction containing planar side walls 12, 14 on a rectangular base with planar end walls 16, 18 joined by semi-cylindrical top 20. Housing 10 contains blower 22 driven by electric motor 24 to induct air into the burner through inlets 26. A control panel 28 mounted on wall 18 of housing 10 contains off-on switch 30 and other control components. Cylindrical blast tube 32 extends from wall 18 of housing 10 and receives combustion air from blower 22. Adjustable mounting flange 34 is slideably fitted on blast tube 32 for abutment against a furnace side wall for insertion of the burner through a furnace wall into a combustion chamber, not shown. Draft control baffles 35 adjust the air flow through the blast tube.

A cylindrical inlet inner tube 36, basically of an L-shape in plan with an elbow 38 formed integral therewith (FIG. 1) or threaded thereon (FIG. 5), has a lateral component 40 terminating in a flange 42 adapted to be bolted by bolts 44 threaded into nuts 46 welded to the inner face of flange 42 through wall slots 48. Fuel inner tube 36 is centered within housing 10 and the inlet 48 of blast tube 32 by flange 42, with axial movement permitted by slots 48, and the outlet end 37 of tube 36 centred concentric with the outlet end 50 of blast tube 32 by fixed vanes 52 secured to tube 36 by welds. Fixed vanes 52 are fastened in preselected positions on the fuel inlet tube 36 to provide a preliminary swirl to the combustion air passing through the annular space 54 between inner tube 36 and blast tube 32. The location of vanes 52 on tube 36 can be determined easily through tests, the optimum position depending on the size and shape of the furnace combustion chamber, not shown.

With reference now to FIGS. 2 and 5, the outlet end 37 of tube 36 projects beyond the outlet end 50 of blast tube 32 whereby discharge outlets 60 of the nozzle formed about the periphery of outlet end 37 of tube 36, closed by cap 62, discharge fuel radially outwardly from the inner tube 36.

A circular spinner blade 64, having a plurality of vanes 66 formed about its periphery, FIGS. 5 and 6, is rigidly secured to the outer end of tube 36 substantially in the plane of the edge of the outlet end 50 of blast tube 32, FIG. 3. The periphery 68 of blade 64 defines a circumference which is less than the inner diameter of the outlet end 50 of blast tube 32 to provide a narrow annular slot 70 adjacent the blast tube.

An ignition system consisting of a spark electrode 72 supported in insulator sleeve 74 carried by inner tube 36, adjusts to a suitable gap from the inner tube adjacent discharge inlets 60 for ignition of the fuel-air mixture.

An ultra-voilet detector is housed in tube 76 which passes through blade 64 for viewing a flame in the combustion chamber to activate a fail-safe system housed in control panel 28.

Internal vanes 52 are tuned to provide the optimum degree of preliminary swirl or turbulence to the inlet air. The degree of swirl produced by the vanes will depend on the velocity of the inlet combustion air and on the length of the blast tube. The vanes 66 on spinner blade 64 impart additional rotational swirl to the combustion air within a more slowly rotating annular flow of air through peripheral slot 70.

In operation, the fuel, normally gaseous, is forced through the nozzle radially outwardly into the swirling combustion chamber. Combustion air is supplied by fan 22 into annular space 54 and forced under pressure past the vanes 52 which impart preliminary swirl to the flow. The gaseous fuel is discharged from the outlets 60 on the perimeter of the innner tube into the rapidly swirling air from vanes 66 and is ignited by a spark from the electrode 72 or by an existing flame as it is mixed with the combustion air.

The inner tube assembly, including two sets of vanes, can be set for a particular fuel flow rate, burner size, blast tube length, and in general for the optimum performance of a given burner. The position of the inner tube inside the blast tube can be adjusted axially, as indicated by arrows 80 in FIG. 3, to optimize efficiency of the burner. When the inner tube must be removed for repair or for cleaning, the entire assembly can be removed and replaced in its original, optimized position, with little difficulty. Alternatively, a damaged assembly can be readily replaced with an equivalent new or rebuilt part, and any damage later repaired at a workshop.

It will be understood that modifications can be made in the embodiment of the invention illustrated and described herein without departing from the scope and purview of the invention as defined by the appended claims.

What we claim as new and desire to protect by Letters Patent of the United States is:

1. A fuel burner comprising, in combination:

a housing having a rectangular base and a pair of opposed side walls;

a cylindrical blast tube extending from said housing adapted to be connected to a source of forced-draft combustion air;

an inner tube substantially concentric with and spaced from said blast tube, defining an annular space therebetween, said inner tube extending from within the housing through the blast tube;

said pair of substantially concentric tubes having inlet and outlet ends, the inlet end of the inner tube having a substantially 90° bend whereby the inlet end of the inner tube abuts a housing side wall inner side, and the outlet end of the inner tube extending beyond the outlet end of the blast tube, said inner tube outlet end having a closed end with equispaced discharge outlets formed around the periphery of the inner tube extending beyond the blast tube forming a nozzle for discharging fuel radially outwardly from said inner tube;

means for removably connecting said inner tube inlet end to the housing side wall inner side, said housing side wall having an opening therein for communicating a source of fluid fuel to the inner tube;

vane means positioned within the annular space, said vane means being fastened to said inner tube at a pre-selected point between the said inlet and outlet ends;

a circular spinner blade mounted at the outlet end of the blast tube, said spinner blade having a diameter smaller than the diameter of the blast tube to define a narrow annular slot adjacent the blast tube and said spinner blade having a plurality of vanes about its periphery, for the discharge of an annular flow of outer air with a swirling flow of inner air;

said inner tube being axially removable from the blast tube and housing without substantially changing the position of the vanes in relation to the inner tube; and means to ignite said fuel.

2. A fuel burner as claimed in claim 1 in which the circular spinner blade has a central opening adapted to receive the inner tube, and means for securing said circular spinner to the inner tube whereby said spinner blade is removable with the inner tube.

* * * * *